US006568330B1

(12) United States Patent
Kaiserman et al.

(10) Patent No.: US 6,568,330 B1
(45) Date of Patent: May 27, 2003

(54) MODULAR MISSILE AND METHOD OF ASSEMBLY

(75) Inventors: Michael J. Kaiserman, Tucson, AZ (US); Michael T. Rodack, Tucson, AZ (US); Arthur J. Schneider, Tucson, AZ (US); Wayne V. Spate, Cortaro, AZ (US); Jennifer B. Weesner, Tucson, AZ (US); Stanton L. Winetrobe, Oro Valley, AZ (US)

(73) Assignee: Raytheon Company, Lexington, MA (US)

( * ) Notice: Subject to any disclaimer, the term of this patent is extended or adjusted under 35 U.S.C. 154(b) by 50 days.

(21) Appl. No.: 09/802,717

(22) Filed: Mar. 8, 2001

(51) Int. Cl.[7] ..... F42B 15/10

(52) U.S. Cl. ..... 102/374; 102/377; 102/378; 102/439; 89/1.7; 89/1.816

(58) Field of Search ..... 102/282, 293, 102/374, 376, 377, 378, 430, 437, 439; 89/1.7–1.706, 1.8, 1.816; 206/3

(56) References Cited

U.S. PATENT DOCUMENTS

| | | | | | |
|---|---|---|---|---|---|
| 185,548 | A | * | 12/1876 | Kenney | 102/464 |
| 2,919,629 | A | * | 1/1960 | Abramson | 102/437 |
| 3,032,970 | A | * | 5/1962 | Fox | 102/374 |
| 3,200,586 | A | * | 8/1965 | Ernest | 60/35.55 |
| 3,216,323 | A | * | 11/1965 | Wengenroth et al. | 102/437 |
| 4,172,420 | A | * | 10/1979 | Voss et al. | 102/437 |
| 4,399,962 | A | * | 8/1983 | Wedertz et al. | 244/3.23 |
| 4,497,460 | A | * | 2/1985 | Thorsted et al. | 244/374 |
| 4,579,298 | A | * | 4/1986 | Thomson | 244/3.21 |
| 4,611,540 | A | * | 9/1986 | Pettersson et al. | 102/374 |
| 4,793,571 | A | * | 12/1988 | Kranz | 244/3.21 |
| 4,925,130 | A | * | 5/1990 | Kranz | 244/3.21 |
| 4,998,994 | A | * | 3/1991 | Schmidt et al. | 244/3.1 |
| 5,005,781 | A | | 4/1991 | Baysinger et al. | 244/3.26 |
| 5,078,336 | A | * | 1/1992 | Carter | 244/3.22 |
| 5,353,710 | A | * | 10/1994 | Eches et al. | 102/443 |
| 5,400,715 | A | * | 3/1995 | Roach et al. | 102/439 |
| 5,494,239 | A | * | 2/1996 | Giacomel | 102/293 |
| 6,227,096 | B1 | * | 5/2001 | Thomas | 102/374 |

* cited by examiner

*Primary Examiner*—Harold J. Tudor
(74) *Attorney, Agent, or Firm*—Renner, Otto, Boisselle & Sklar, LLP

(57) ABSTRACT

A modular missile assembly includes a pair of modules which are separately transported and handled until just prior to firing, when they are coupled together. A forward payload-carrying module includes a forward canister which encloses a missile payload section, for example, consisting of a penetrator rod, fins, and ancillary sub-assemblies. An aft booster module includes a missile propulsion section, encased in an aft canister. Prior to firing, suitable forward and aft modules are selected, are individually loaded into a launch tube, and are coupled together. In this coupling the missile payload section and the missile propulsion section are coupled together to form a missile, and the forward and aft canisters are likewise coupled together to form a combined canister assembly. Division of the missile into separate payload and booster modules facilitates handling as compared to unitary missiles. The modular design also allows increased flexibility.

26 Claims, 3 Drawing Sheets

MODULAR MISSILE AND METHOD OF ASSEMBLY

BACKGROUND OF THE INVENTION

1. Field of the Invention

The invention is in the field of missiles and methods of configuring and/or assembling missiles.

2. Description of the Related Art

For certain missile systems, for example, high-kinetic-energy anti-tank missiles and cruise missile interceptors, it is desirable to accelerate a projectile to high speed, such as supersonic or hypersonic speeds. At such speeds the projectile intercepts the target in a minimum amount of time, and has sufficient energy to penetrate and destroy the target. However, boosting the projectile to the required speed necessitates use of a large rocket motor. Moreover, to assure that adequate kinetic energy is delivered to the target, a heavy projectile is required. When combined, these two requirements may result in a missile having an extraordinarily high pre-launch weight. In tactical deployment, excessively heavy missiles make forward-staging, loading, downloading, storage and other handling operations slow and difficult. Missile weights that exceed established thresholds for manual handling may require special equipment such as autoloaders.

An exemplary tactical kinetic energy anti-tank missile utilizes a rocket motor weighing from 65 to 70 pounds, and a projectile weighing between 15 and 25 pounds. To these figures must be added the weight of any control surfaces, electronics, actuation systems, and supporting structural elements. Consequently, the total pre-launch weight of such a missile may easily exceed 100 pounds.

From the foregoing it will be appreciated that it would be desirable to avoid the handling difficulties associated with missiles having a high weight.

SUMMARY OF THE INVENTION

A modular missile assembly includes a pair of modules which are separately transported and handled until just prior to firing, when they are coupled together. A forward payload-carrying module includes a forward canister which encloses a missile payload section, for example, consisting of a penetrator rod, fins, and ancillary sub-assemblies. An aft booster module includes a missile propulsion section, encased in an aft canister. Prior to firing, suitable forward and aft modules are selected, are individually loaded into a launch tube, and are coupled together. In this coupling the missile payload section and the missile propulsion section are coupled together to form a missile, and the forward and aft canisters are likewise coupled together to form a combined canister assembly. Division of the missile into separate payload and booster modules facilitates handling as compared to unitary missiles. The modular design also allows increased flexibility, for example, allowing a single booster module to be used with different types of payload-carrying modules, carrying different types of missile payload sections, which may be tailored for use with different kinds of targets.

According to an aspect of the invention, a missile assembly includes a forward payload-containing module having a first coupling mechanism at a back end; and an aft booster module having a second coupling mechanism at a front end. The first and second coupling mechanisms are operatively configured to couple the modules together in a launch tube.

According to another aspect of the invention, a method of assembling a missile includes the steps of individually loading a pair of missile modules into a launch tube; and coupling the modules together in the launch tube.

According to yet another aspect of the invention, a missile payload section includes a missile payload section which in turn includes a penetrator rod, fins coupled to the penetrator rod, and means operatively configured for coupling to a corresponding missile propulsion section, wherein the means for coupling is at an aft end of the payload section; a canister which fits around the payload; and a cap removably secured to an aft end of the canister. The cap, when secured, covers the means for coupling.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in injunction with the drawings.

DETAILED DESCRIPTION

A modular missile assembly includes a forward payload-containing module and an aft booster module. The forward module includes a forward canister containing a missile payload section including a payload such as a projectile for striking a target. The aft module includes an aft canister containing a missile propulsion system such as a rocket motor. The forward and aft modules may be handled separately until firing is desired. Then the modules are loaded into a launch tube and connected together, thereby completing assembly of the missile. By having the modules separate until firing is desired, handling is facilitated, since each of the modules weighs far less than the combined missile. Furthermore, use of separate modules enables greater flexibility in missile payloads. Multiple varieties of payload modules, for example for use with different targets, may be manufactured to be compatible with a single type of booster module. Selection of the payload module may be made in the field prior to firing. Since only a variety of payload modules need be maintained in inventory, as opposed to a variety of complete missiles, inventories and therefore costs may be reduced.

Figure 1:
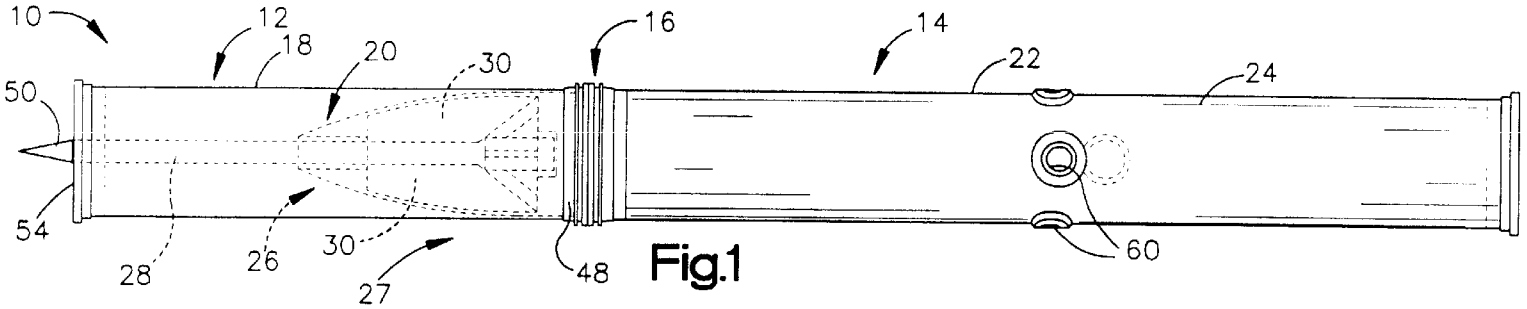
FIG. 1 is a side view of a modular missile assembly of the present invention.

Turning now to FIG. 1, a modular missile assembly 10 of the present invention is shown. The missile assembly 10 includes a forward payload-carrying module 12 and an aft booster module 14. The modules 12 and 14 are coupled together via a coupling 16. As described below in greater detail, the forward module 12 includes a forward canister 18 which encloses a missile payload section 20, and the aft module 14 includes an aft canister 22 which encloses a missile propulsion section 24. The propulsion section 24 may include subsystems and subassemblies, such as electronics, controls, and deployable stabilizing fins. The coupling connects the payload section 20 and the propulsion section 24 together to form a modular missile 26. The coupling 16 also connects the canisters 18 and 22 together to form a canister assembly 27.

Figure 2:
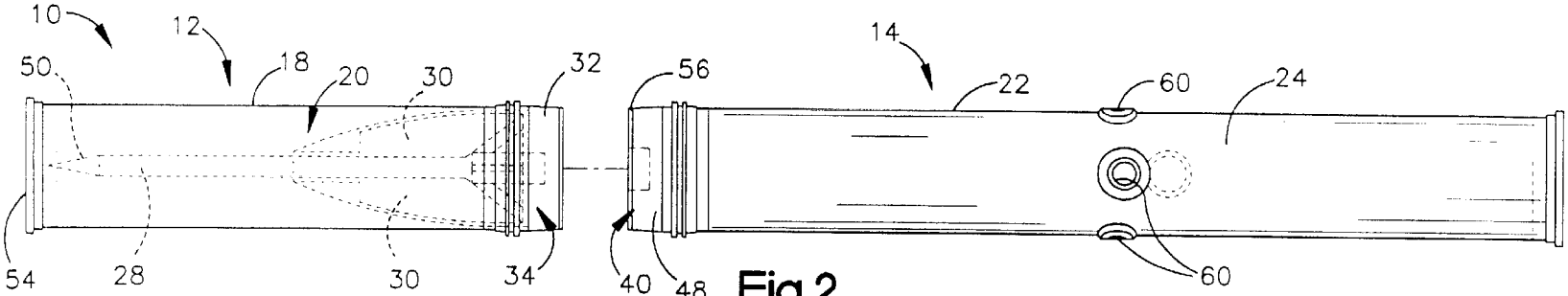
FIG. 2 is a side view showing the modules of the missile of FIG. 1 prior to connection.
Figure 3:
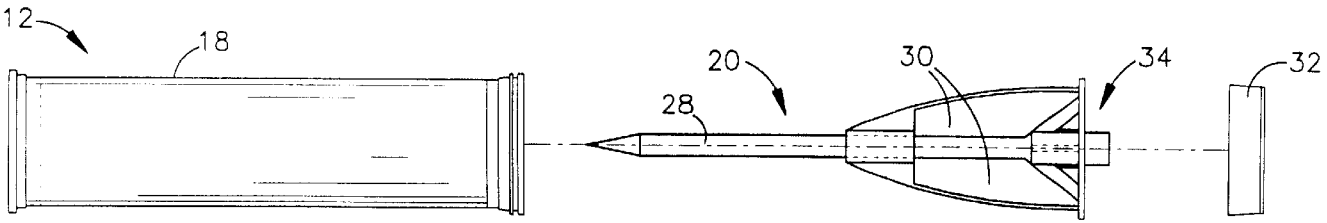
FIG. 3 is an exploded view of the forward payload-carrying module of the missile assembly of FIG. 1.
Figure 4:
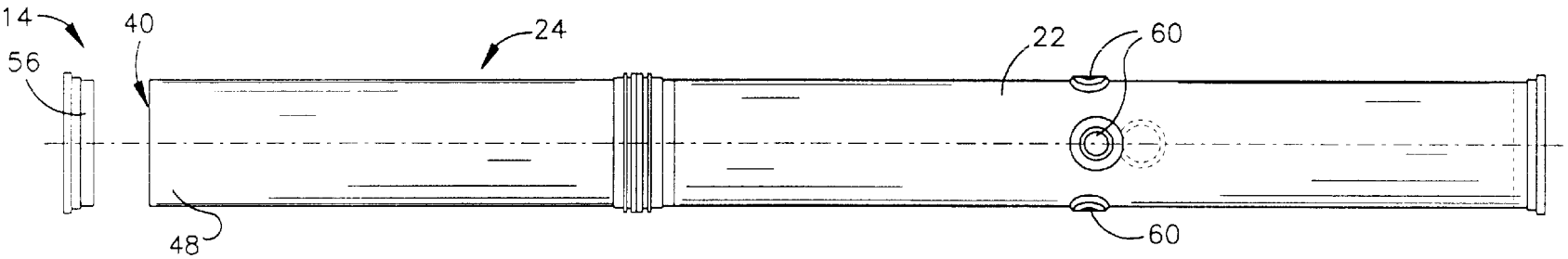
FIG. 4 is an exploded view of the aft booster module of the missile assembly of FIG. 1.

Turning now to FIGS. 2–4, details may be seen of the modules 12 and 14. The missile payload section 20 includes a penetrator rod 28, as well as fins 30 which are coupled to the penetrator rod. The penetrator rod 28 may be made of a heavy material, for example tungsten or depleted uranium, selected to penetrate a desired target. It will be appreciated that a variety of sizes, shapes, and/or materials may be employed in the penetrator rod 28.

The fins 30 may be stabilizing fins for stabilizing flight of the missile 26. Alternatively or in addition, the fins 30 may be canted so as to impart and/or maintain rotation of the missile 26 while the missile is in flight. The fins 30 may include folded portions which deploy as the payload section 20 emerges from the forward canister 18 and/or from a launch tube.

The payload section 20 may include other items such as a secondary propulsion system, a chemical energy target defeat mechanism, sensors and micro-electronics. The sensors and the micro-electronics may be utilized to aid in guiding the missile 26 to its intended target. It will be appreciated that the missile 26 may be guided by any of a variety of known means. For example, actuators may be used to move one or more of the fins 30, thereby altering the trajectory of the missile 26.

A forward cap 32 may be removably secured to the forward canister 18 until just prior to the connection of the forward module 12 to the aft module 14. The forward cap 32 covers and protects a forward connection 34 at the back end of the payload section 20. The forward cap 32 may also be secured to the payload section 20, thereby holding the payload section in place relative to the forward canister 18, prior to the assembly of the missile 10.

It will be appreciated that the forward cap 32 may be secured to the forward canister 18 and/or to the payload section 20 by any of a variety of conventional means, including connections involving quick-release clamps, pins, springs, threaded fasteners, or other connections, tabs, and/or the mating together of indexed parts.

The aft booster module 14 includes an aft connection 40 which is operatively configured to couple to the forward connection 34 of the forward module 12, the connections 34 and 40 being configured to combine to form the coupling 16. The connections 34 and 40 may be any of a variety of suitable well-known means of connection. For example, the connections 34 and 40 may include a mechanical index system where features on one of the connections 34 and 40 has a corresponding mirror image feature on the other connection. For example, the connections may involve a pilot shaft on one component, or a positioning and locking mechanism on the outer edges of the connections 34 and 40. It will be appreciated that a variety of suitable locking mechanisms may be employed, such as, for example, mechanisms involving springs and/or tabs.

The coupling 16 formed by connecting the connections 34 and 40 together may be merely a mechanical connection. Alternatively, the coupling 16 may include a connection for other purposes, for example, including a communication link between the payload section 20 of the forward module 12 and the propulsion section 24 of the aft booster module 14. As noted above, the coupling 16 may also include a connection between the forward canister 18 and the aft canister 22.

The aft connection 40 is located on a protruding portion 48 of the propulsion section 24. When the missile 10 is assembled, the protruding portion 48 extends into the forward canister 18 and pushes the payload section 20 forward relative to the forward canister 18. A tip 50 of the penetrator rod 28 may thereby extend beyond a front edge 54 of the forward canister 18. A removable aft cap 56 may be used to cover the protruding portion 48 and the aft connection 40, prior to the assembly of the modules 12 and 14 to form missile assembly 10.

The missile propulsion section 24 may be of conventional design, for example, including a solid fuel rocket having one or more nozzles. As is well known, some or all of the nozzles may be canted to provide spin to the missile 26, if desired. In addition, some or all of the nozzles may be tiltable, for example, to provide steering for the missile. An example of a mechanism for tilting missile nozzles may by seen in U.S. Pat. No. 3,200,586, the detailed description and figures of which are incorporated herein by reference.

The aft canister 22 may have protuberances such as lugs 60. The lugs 60 may be used to index the missile assembly 10 relative to a launch tube.

Figure 5:
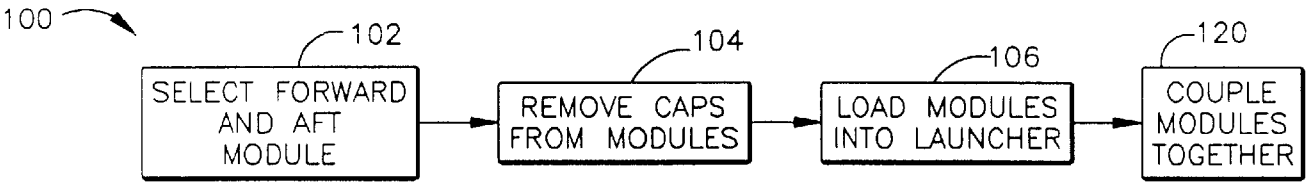
FIG. 5 is a flowchart illustrating steps in the assembly of the missile assembly of FIG. 1.

Turning now to FIG. 5 a flowchart is shown of a method 100 for selecting components and assembling the missile assembly 10. The method 100 is advantageous in that its steps may be performed in the field immediately prior to the firing of the missile 26. As indicated before, this may increase flexibility as to the types of payloads employed, may reduce field inventory requirements, and/or may reduce or avoid handling problems associated with heavy missiles.

In step 102, the desired forward and aft modules 12 and 14 are selected. The forward module 12 may be selected from a variety of types of forward modules. For example, a variety of types of modules with different payloads may be maintained for use with different types of targets. For example, it may be desirable to use a lighter payload for a lightly-armored target, such as a helicopter, while using a heavier payload for a heavier target, such as a tank. Further, it may be desirable to have practice rounds which utilize less expensive payloads.

It will also be appreciated that a variety of types of aft booster portions may be maintained. For example, different types of booster portions may be used to provide different amounts of thrust and/or different thrust characteristics.

Figure 6:
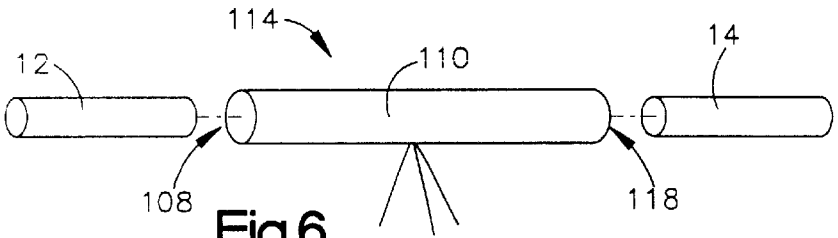
FIG. 6 is a side view illustrating the loading of the modules of the missile assembly of FIG. 1 into a launch tube of a launcher.

Once the modules 12 and 14 have been selected, the module caps 32 and 56 are removed in step 104, and the modules are loaded into a launch tube in step 106. As illustrated in FIG. 6, the forward payload-carrying module 12 may be loaded into a front end 108 of a launch tube 110 of a launcher 114. The aft booster module 14 may be loaded in a back end 118 of the launch tube 110. It will be appreciated that alternatively the modules 12 and 14 may be loaded in the same end of the launch tube 110, if desired. It will also be appreciated that there may be a set order for the loading of the modules 12 and 14, or alternatively that the modules may be loaded in either order.

In step 120, the modules 12 and 14 are coupled together within the launch tube 110. Modules 12 and 14 are coupled as described above, through use of the coupling 16, to thereby form the missile assembly 10. After coupling, the missile 10 may be fired from the launcher 114 in a convention manner. After firing, the coupled canister of the modules 12 and 14 (the forward canister 18 and the aft canister 22) may be removed from the launch tube 110 as a single piece.

It will be appreciated that it may be possible to assemble the modules 12 and 14 of the missile assembly 10 wholly or partially outside of the launch tube 110. However, such outside assembly may result in handling difficulties due to a need to handle the fully-assembly missile assembly 10.

What follows now are several additional embodiments of the invention. The details of certain common similar features of the additional embodiments and the embodiment or embodiments described above are omitted in the description of the additional embodiments for the sake of brevity. It will be appreciated that features of the various additional embodiments may be combined with one another and may be combined with features of the embodiment or embodiments described above.

Figure 7:
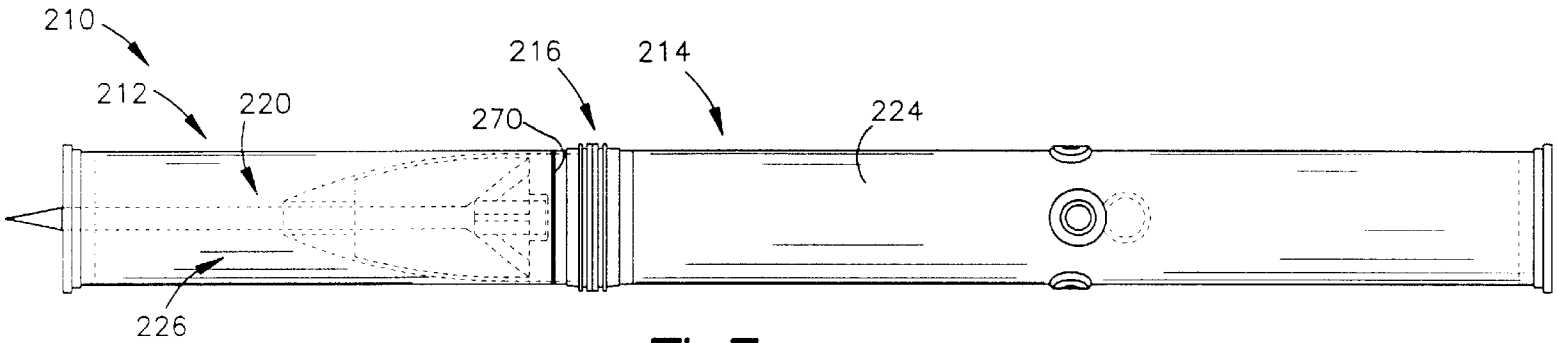
FIG. 7 is a side view of a missile assembly embodying the present invention, which separates during flight.

FIG. 7 shows a modular missile assembly 210 which includes a missile 226 which separates into two parts during flight. The missile assembly 210 includes a forward payload-carrying module 212, which is coupled to an aft booster module 214 via a coupling 216. The forward module 212 includes a payload section 220, which is coupled to a missile propulsion section 224 of the aft module 214. During flight, the missile 226 separates along a separation line 270. The part of the missile 226 which is forward of the separation line 270 continues along toward the intended target. The part of the missile 226 which is behind the separation line 270 is jettisoned. Jettisoning the rear part of the missile 226 reduces deceleration on the remaining part of the missile, which would otherwise occur due to aerodynamic drag forces on the rear section. Thus, range and/or accuracy of the missile may be improved.

Separation along the separation line 270 may be accomplished by any of a variety of suitable mechanisms. For example, separation may be triggered by a system that senses mechanically the difference in forces between the forward and aft portions of the missile after the rocket motor has burned out. Alternatively, an accelerometer may be used as a trigger to decouple the parts of the missile. As another example, the decoupling of the parts may be set to occur after a certain given time from launch. The decoupling along the separation line 270 may be a purely passive event, or may alternatively involve use of active components such as electromechanical, pyrotechnic, or other small devices to aid in the separation.

It will be appreciated that the separation line 270 may be located on the missile 226 other than at the location shown in FIG. 7. The separation line 270 may be located on the payload section 220, at the coupling between the payload section 220 and the propulsion section 224, or somewhere along the propulsion section 224. It will be appreciated that the separation mechanism may be incorporated as part of the coupling 216 between the modules 212 and 214.

Figure 8:
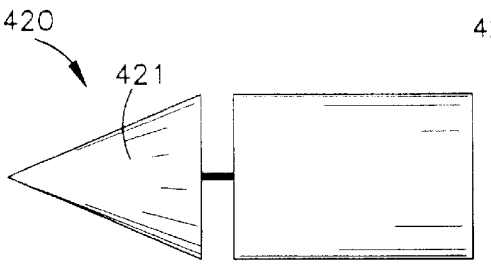
FIG. 8 is a side view of a missile payload section for a missile of the present invention, the payload section including an articulated nose section.

Turning now to FIG. 8, an alternate embodiment missile payload section 420 includes an articulated nose portion 421. The articulated nose portion advantageously provides steering with minimal effect on external projectile packaging, minimum drag characteristics, and smooth, continuous steering. It is well known that a simple steering mechanism can be achieved by always pointing the nose toward the target, therefore allowing resultant aerodynamic forces to fly the payload section 420 toward the target.

It will be appreciated that a variety of actuation implementation systems may be employed to articulate the nose. U.S. Pat. No. 4,399,962, the detailed description and figures of which are incorporated herein by reference, is an example of employment of pyrotechnic devices to articulate a nose section. U.S. Pat. No. 4,793,571, the detailed description and figures of which are incorporated by reference, discloses use of piezolectric devices to articulate a nose. U.S. Pat. No. 4,998,994, the detailed description and figures of which are incorporated by reference, discloses a self-aligning projectile nose. Also, a variety of suitable mechanical means for articulating the nose may be employed. Examples of mechanical articulation of nose sections may be found in U.S. Pat. Nos. 4,579,298 and 4,925,130, detailed descriptions and figures of which are incorporated by reference, and in pending, commonly-owned U.S. Pat. No. 6,364,248, titled "Articulated Nose Missile Control Actuation System," filed Jul. 6, 2000, which is incorporated herein by reference in its entirety.

Figure 9:
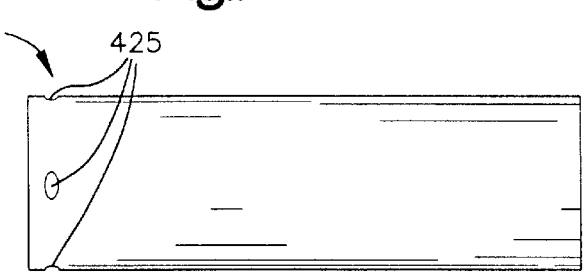
FIG. 9 is a side view of a missile propulsion section for a missile assembly of the present invention which utilizes a torque motor to impart spin.

FIG. 9 shows an alternate embodiment missile propulsion section 424 which includes nozzles 425 along the perimeter of the propulsion section. The nozzles 425 may be used to impart a spin or torque to the missile during or shortly after launch. It is well known that imparting a spin to a missile may improve its accuracy. Further details regarding use of circumferentially-placed nozzles to impart a spin to a missile may be found in pending, commonly owned U.S. Pat. No. 6,478,250, entitled "Propulsive Torque Motor," filed Sep. 11, 2000, which is herein incorporated by reference in its entirety.

As mentioned earlier, It will be appreciated that other well-known methods are available for imparting a spin or a torque to a missile. Examples of such other methods may be found in U.S. Pat. Nos. 4,497,460 and 5,078,336, the descriptions and figures of which are herein incorporated by reference.

Figure 10:
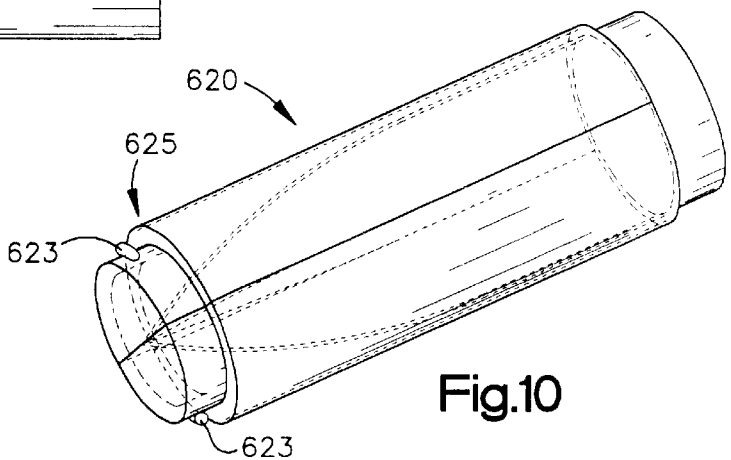
FIG. 10 is a side view of a missile payload section for use in a modular missile assembly of the present invention, the missile payload section including a torque motor in its forward payload-carrying module.

FIG. 10 shows an alternate embodiment missile payload section 620 which incorporates a propulsive torque motor. In an exemplary embodiment, the payload section 620 includes a pressurized gas source. Pressurized gas may be ejected through nozzles 623 at a front end 625 of the payload section. The nozzles 623 the pressurized gas in a direction having a tangential component relative to the missile payload section, thereby imparting a spin to the missile. Further details of an example of such a torque motor may be found in the above-referenced U.S. Pat. No. 6,478,250, entitled "Propulsive Torque Motor."

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A missile assembly comprising:

a forward payload-containing module having a first coupling mechanism at a back end; and an aft booster module having a second coupling mechanism at a front end;

wherein the first and second coupling mechanisms are couplable together so as to couple the modules together in a launch tube;

wherein the forward module includes a missile payload section and the aft module includes a missile propulsion section, wherein coupling the coupling mechanisms within the launch tube locks the payload section and the propulsion section together to form a missile.

2. The missile assembly of claim 1, wherein the missile propulsion section is a rocket motor.

3. The missile assembly of claim 1, wherein the forward module further includes a forward canister, separate from the missile payload section, and at least partially surrounding the missile payload section, wherein the aft module further includes an aft canister, separate from the missile propulsion section, and at least partially surrounding the missile propulsion section, and wherein coupling the coupling mechanisms within the launch tube separately connects the forward canister and the aft canister together.

4. The missile assembly of claim 3, wherein the payload section includes a penetrator rod.

5. The missile assembly of claim 4, wherein, when the coupling mechanisms are coupled, a tip of the penetrator rod protrudes from the forward cannister.

6. The missile assembly of claim 5, wherein the payload section also includes fins coupled to the penetrator rod.

7. The missile assembly of claim 3, wherein the aft canister has at least one lug thereupon.

8. The missile assembly of claim 3, wherein a protruding part of the propulsion section is operatively configured to protrude into the forward canister when the modules are coupled.

9. The missile assembly of claim 1, wherein the missile is operatively configured to separate into two or more parts during flight.

10. The missile assembly of claim 9, wherein the coupling mechanisms include a separation mechanism for separating the payload section from the propulsion section.

11. The missile assembly of claim 1, wherein the payload section includes a penetrator rod and fins coupled to the penetrator rod.

12. The missile assembly of claim 1, wherein the payload section includes means for steering.

13. The missile assembly of claim 1, wherein the payload section includes an articulated nose portion.

14. The missile assembly of claim 1, wherein the payload section includes an external spin motor operatively configured to spin the missile.

15. The missile assembly of claim 1, wherein the propulsion section includes means to spin the missile.

16. The missile assembly of claim 15, wherein the means to spin includes means for releasing pressurized gas tangentially to the missile.

17. A missile assembly comprising:

a forward payload-containing module that includes:

a missile payload section;

a forward canister, separate from and surrounding the missile payload section; and a first connection at a back end of the payload-containing module; and an aft booster module that includes:

a missile propulsion section;

an aft canister, separate from and surrounding the missile propulsion section; and a second connection at a front end of the booster module;

wherein the connections are connected together within a launch tube to form a locking coupling between the modules.

18. The missile assembly of claim 17, wherein the locking coupling lockingly connects the payload section and the propulsion section together.

19. The missile assembly of claim 18, wherein the coupling also connects the forward cannister and the aft cannister.

20. The missile assembly of claim 19, wherein a protruding part of the propulsion section protrudes into the forward canister.

21. The missile assembly of claim 18, wherein the payload section and the propulsion section together form a missile that is not attached to the canisters.

22. The missile assembly of claim 21, wherein the missile is ejected from the canisters upon launch.

23. The missile assembly of claim 19, wherein the payload section includes:

a penetrator rod; and fins coupled to the penetrator rod.

24. The missile assembly of claim 17, wherein a tip of the penetrator rod protrudes from the forward cannister.

25. The missile assembly of claim 17, wherein the coupling is engaged and locked by pushing the connections together.

26. The missile assembly of claim 17, wherein the missile propulsion section includes a rocket motor.

* * * * *